US011762335B2

(12) United States Patent
Avril et al.

(10) Patent No.: US 11,762,335 B2
(45) Date of Patent: Sep. 19, 2023

(54) CROWN-PUSH-BUTTON FOR A TIMEPIECE

(71) Applicant: MECO SA, Grenchen (CH)

(72) Inventors: Hervé Avril, Les Breuleux (CH); Daniel Danguzov, Worben (CH)

(73) Assignee: MECO SA, Grenchen (CH)

( * ) Notice: Subject to any disclaimer, the term of this patent is extended or adjusted under 35 U.S.C. 154(b) by 246 days.

(21) Appl. No.: 17/369,041

(22) Filed: Jul. 7, 2021

(65) Prior Publication Data

US 2022/0163921 A1 May 26, 2022

(30) Foreign Application Priority Data

Nov. 25, 2020 (EP) ..... 20209679

(51) Int. Cl.
*G04B 3/04* (2006.01)
*G04G 21/08* (2010.01)
*G04C 3/00* (2006.01)

(52) U.S. Cl.
CPC ..... *G04B 3/046* (2013.01); *G04C 3/004* (2013.01); *G04G 21/08* (2013.01)

(58) Field of Classification Search
CPC ..... G04C 3/004; G04C 3/008; G04B 3/046; G04B 3/04; G04B 3/041; G04B 3/043; G04B 37/103; G04B 37/04; G04B 19/286; G04B 19/28; G04B 37/06; G04B 27/004; G04G 21/08; G04G 21/00
See application file for complete search history.

(56) References Cited

U.S. PATENT DOCUMENTS

| | | | | |
|---|---|---|---|---|
| 7,318,670 | B2 * | 1/2008 | Cretin | G04B 27/004 368/320 |
| 8,371,745 | B2 | 2/2013 | Manni | |
| 10,613,481 | B2 * | 4/2020 | Iguchi | G04B 3/041 |
| 11,042,122 | B2 * | 6/2021 | Iguchi | G04B 3/041 |
| 11,366,428 | B2 * | 6/2022 | Avril | G04G 21/00 |

FOREIGN PATENT DOCUMENTS

| | | |
|---|---|---|
| CH | 703622 A2 | 2/2012 |
| CH | 708958 A2 | 6/2015 |
| EP | 3339966 A1 | 6/2018 |

OTHER PUBLICATIONS

European search report for European application EP 20209679 dated Apr. 30, 2021.

* cited by examiner

*Primary Examiner* — Edwin A. Leon
(74) *Attorney, Agent, or Firm* — Sughrue Mion, PLLC

(57) ABSTRACT

A crown-push-button (3) provided with a spring (10) disposed within a cage (11) integral in rotation with the movement of the head (4) of the crown-push-button (3), the spring (10) being arranged within the cage (11) so as to be rotated with the cage. The base (13*c*) of the spring cage is provided with cells (18) cooperating with protuberances (17) formed in a washer (14) disposed on the seat (6*a*) of the tube (6) of the crown-push-button, the rotation of the crown-push-button being then accompanied by a click as the protuberances (17) pass in the cells (18), which allows the user to ensure that the desired functions have been activated.

18 Claims, 5 Drawing Sheets

CROWN-PUSH-BUTTON FOR A TIMEPIECE

CROSS-REFERENCE TO RELATED APPLICATIONS

This application claims priority to European Patent Application No. 20209679.8, filed on Nov. 25, 2020, the entire contents of which are incorporated herein by reference.

OBJECT OF THE INVENTION

The present invention relates to the field of watchmaking and more specifically to an arrangement of a spring within a crown-push-button and to the means allowing to accompany the rotation of the crown-push-button with a click.

TECHNOLOGICAL BACKGROUND AND PRIOR ART

The crown-push-buttons equipping timepieces are provided with a return spring which is positioned around the rod of the crown. The spring generally bears at one end under the head of the crown and at its other end on a bearing surface of the crown tube or on a washer disposed on this same bearing surface. In use, the relative movement between the spring and the rotating components of the crown-push-button causes a scratching phenomenon and thereby premature wear of the spring.

From application EP 19212451, a crown-push-button provided with a spring disposed within a cage integral in rotation with the movement of the head is known, the spring being arranged within the cage so as to be rotated with the cage. This arrangement of the spring within a cage allows to avoid a scraping effect between the spring and the recess bottom of the crown and thereby increases the life of the spring. As the cage rotates with the spring when an action is performed on the crown-push-button, the spring is not subjected to relative movement with a component. Furthermore, since the cage has faces with a shape similar to that of the faces on which it bears, a normal friction is present in the bearing area, which ensures continuous drive of the crown.

The crown-push-buttons provided with the spring cage according to the aforementioned application equip, among others, electronic watches. The crown-push-button is then kinematically linked to a multipolar magnet intended to cooperate with one or more sensors. The rotation of the crown-push-button is therefore not subject to mechanical resistance, with the consequence that the user may have the impression of rotating the head of the crown-push-button in a vacuum.

SUMMARY OF THE INVENTION

The object of the present invention is to improve the crown-push-button provided with the spring cage according to the prior art.

To this end, the base of the spring cage is provided with cells cooperating with protuberances formed in a washer disposed on the seat of the tube of the crown-push-button. The rotation of the crown-push-button is then accompanied by a click as the protuberances pass in the cells, which allows the user to ensure that the head of the crown-push-button is actually rotating.

The shape of the protuberances and the corresponding cells has been determined by finite elements to ensure a click without the risk of blocking the crown due to the force of the spring. The number of these protuberances and corresponding cells was also determined to adjust the desired torque. These parameters were associated with the theoretical rotational speeds of the crown-push-button and with tests to avoid the system going into resonance as well as not to penalise the life of the spring with fatigue. This design with a washer allows the design of the washer to be adjusted on the basis of several technical parameters by modifying only one part which is the washer and not the entire crown-push-button system.

The features and advantages of the present invention will become apparent upon reading the detailed description below with reference to the following figures.

DETAILED DESCRIPTION OF THE INVENTION

The present invention relates to a crown-push-button intended to equip a timepiece. According to the invention, the rotation of the crown-push-button is accompanied by a "click" allowing the user to feel that he has correctly actuated the crown-push-button. The crown-push-button according to the invention is more specifically adapted for an application where the actuation takes place without mechanical resistance, for example for an electronic watch or for a mechanical watch provided with a magnetic crown-push-button.

Figure 1:
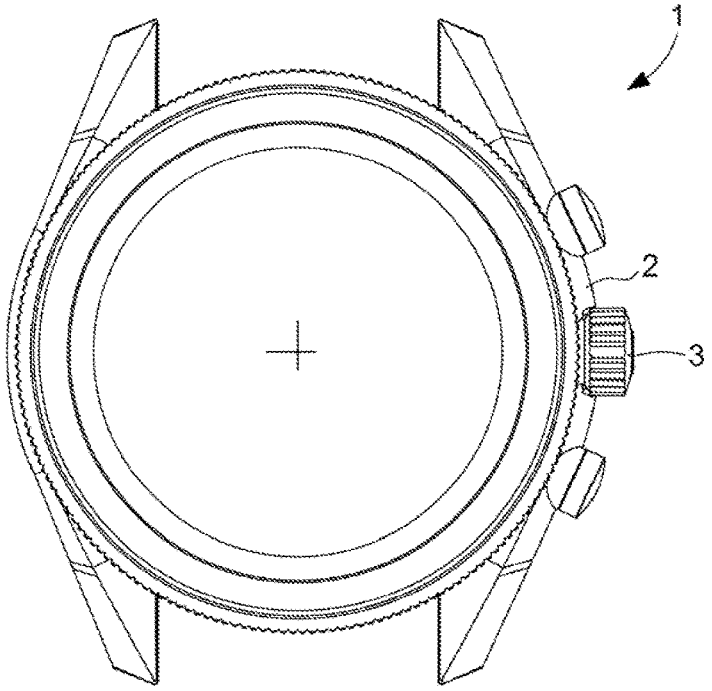
FIG. 1 shows a plan view of a timepiece provided with a crown-push-button according to the invention.
Figure 2:
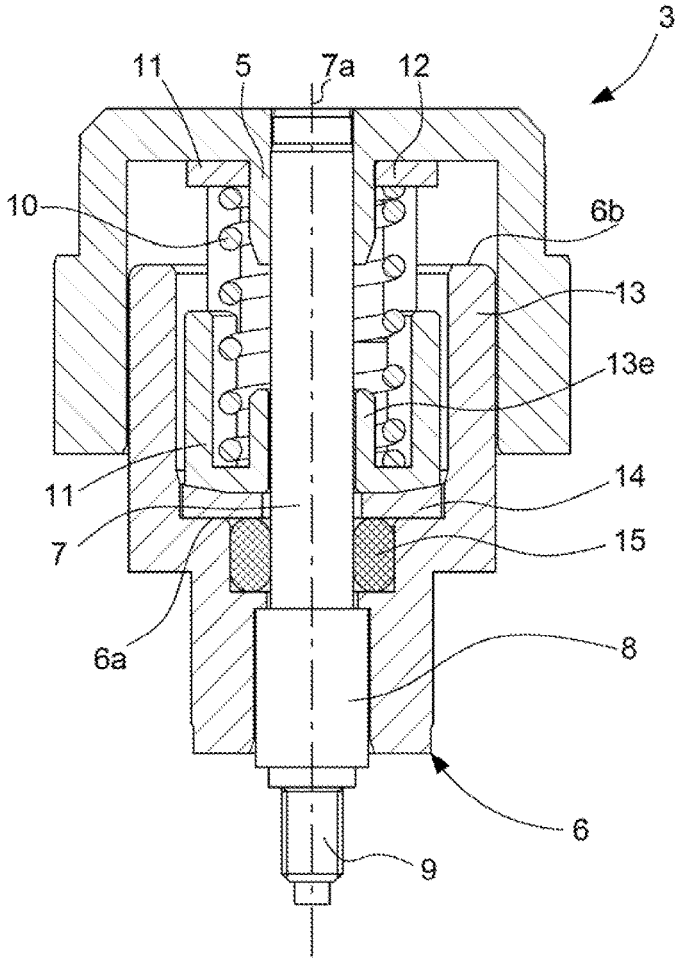
FIG. 2 shows a longitudinal sectional view of the crown-push-button according to the invention.

Referring to FIGS. 1 and 2, the timepiece conventionally includes a case 1 provided with a middle part 2 and a crown-push-button 3 including a recessed head 4 integral with a rod 7 moving in a tube 6 fixed to the middle part. The tube 6 is traversed by the rod 7 connected to the recessed head 4.

The recessed head 4 is mounted movable in translation and in rotation respectively along and around the axis 7*a* of the rod 7. According to the variant shown in FIG. 2 for an electronic watch, the rod 7 is integral at its base with a retaining element 8. A magnet 9, for example a multipolar magnet is fixed to the distal end of the rod 7 intended to cooperate with one or more sensors (not shown). For a mechanical watch, the rod can actuate a function such as a chronograph function.

The crown-push-button 3 further includes a spring 10 disposed around the rod 7. According to the invention, the return spring 10 is mounted in compression within a cage 11 visible in more detail in FIG. 3. The cage 11 is disposed between the tube 6 and the rod 7. It bears at one axial end on an inner face of the recessed head 4 and at its other axial end on a seat 6*a* of the tube 6 or, preferably, on a washer 14 promoting sliding, the washer 14 being disposed on this same seat 6*a*. The cage 11 is made of two distinct upper 12 and lower 13 portions with the upper portion 12 integral with the recessed head 4. To this end, the upper portion 12 is fixed to a core 5 extending partially around the rod 7 from the inner face of the recessed head 4. The two upper 12 and lower 13 portions cooperate or, in other words, fit into each other. The upper portion 12 of the cage is integral in rotation with the recessed head 4, while the lower portion 13 of the cage is axially free relative to the recessed head but rotated by the upper portion of the cage during the rotation of the recessed head. Furthermore, the upper portion 12 is mounted on the lower portion 13 so as to be able to move in translation along the axis 7*a* of the rod 7 when the crown-push-button is pressed. Different configurations are possible to ensure the rotational cooperation of the two portions and the translational movement of the upper portion relative to the lower portion. According to the variant of FIG. 3 described in more detail below, the upper portion 12 has at least one portion 12*f* fitted in an opening 13*b* of the lower portion 13. By way of example, according to another variant not shown, the upper portion may have at least one portion sliding within a slide formed on an inner wall of the lower portion.

Figure 3:
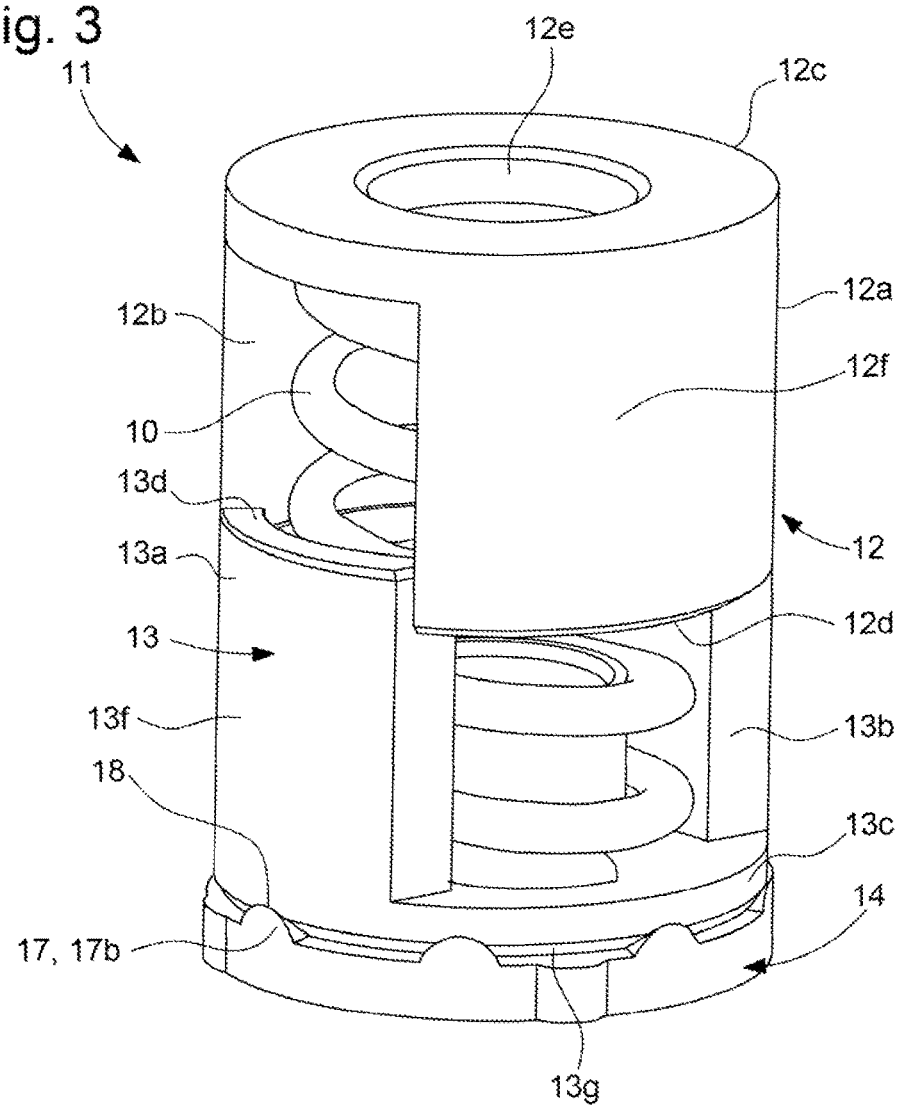
FIG. 3 shows a three-dimensional view of the spring cage mounted on a washer according to the invention.
Figure 11:
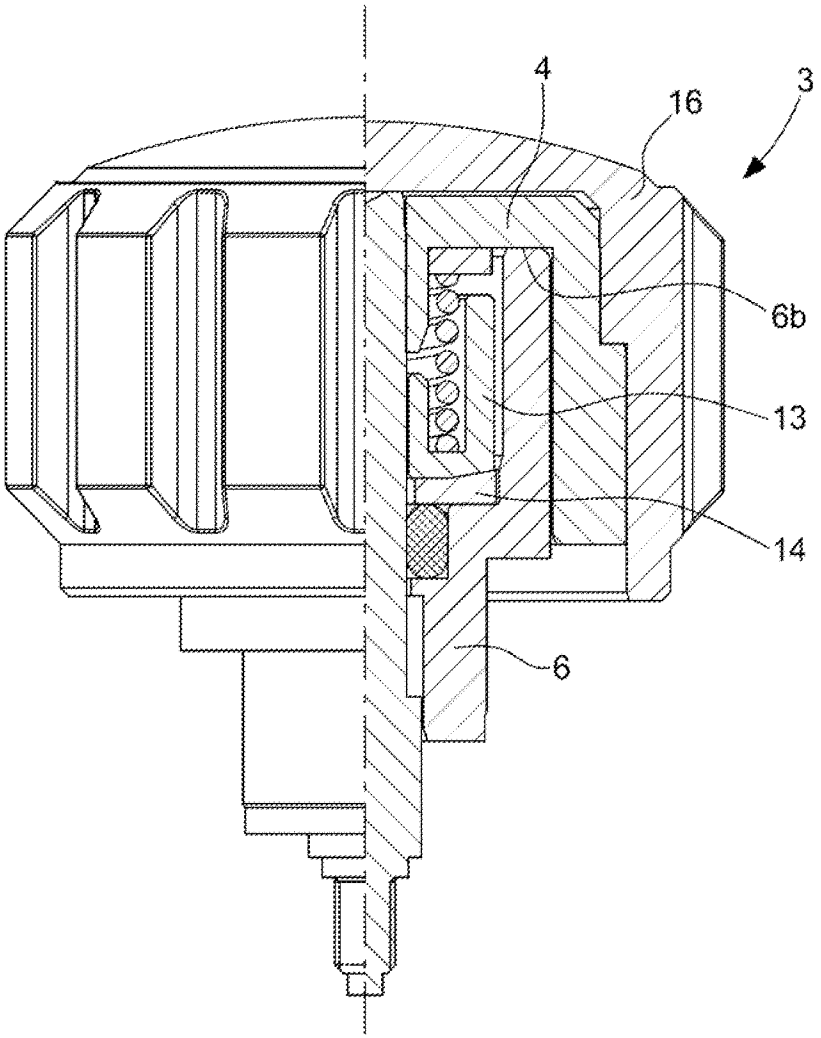
FIG. 11 shows the same view of the crown-push-button in the pressed position.
Figure 10:
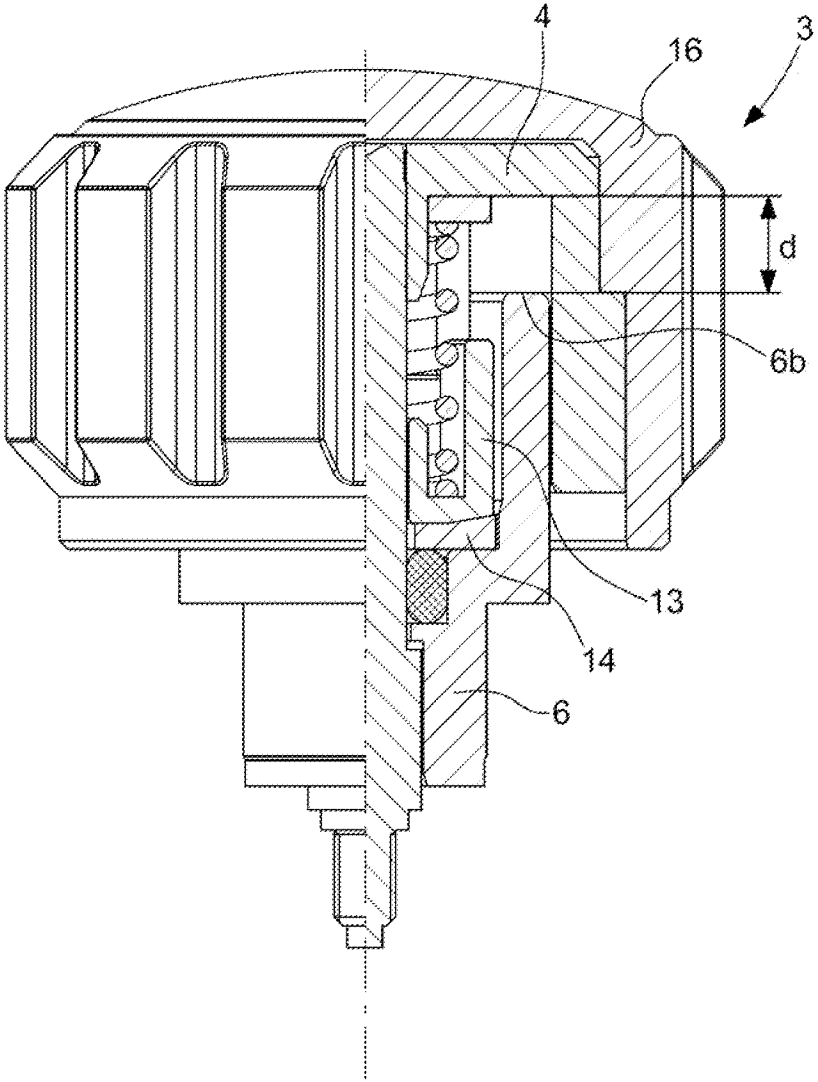
FIG. 10 is a longitudinal half-sectional view of the crown-push-button according to the invention in the final mounted position in the timepiece.

Referring to the variant of FIG. 3, each portion 12, 13 has a cylindrical shape with a side wall 12*a*, 13*a* provided with at least one opening 12*b*, 13*b* and preferably with two openings, or even three, four openings, etc. The side wall 12*a*, 13*a* is delimited at one end by a base 12*c*, 13*c* pierced with a central hole and at the other end by a fully open base 12*d*, 13*d*. The openings 12*b*, 13*b* cut in the side wall 12*a*, 13*a* define the contours of a U. In the example illustrated, the two openings are diametrically opposite. The openings 12*b*, 13*b* are delimited by portions 12*f*, 13*f* of the side wall 12*a*, 13*a*. The side wall 12*a*, 13*a* is thus formed of portions 12*f*, 13*f* framed by the openings 12*b*, 13*b*. According to the invention, the two portions 12, 13 are mounted in the opposite direction relative to each other, coaxially along the rod 7 and with an angular displacement of 90° relative to each other. Thus, the open bases 12*d*, 13*d* face each other and the portions 12*f* of the side wall 12*a* of the upper portion 12 are fitted in the openings 13*b* of the side wall 13*a* of the lower portion 13 so as, on the one hand, to allow the movement in translation of the upper portion relative to the lower portion and, on the other hand, so that the rotating upper portion can drive the lower portion in its movement. In the deployed position of the crown-push-button 3 as shown in FIGS. 2, 3 and 10, the portions 12*f* of the side wall 12*a* of the upper portion 12 are slightly engaged in the respective openings 13*b* of the lower portion 13. In the pressed position of the crown-push-button 3 as shown in FIG. 11, the portions 12*f* of the side wall 12*a* engage deeper into the openings 13*b*. The maximum stroke d shown in FIG. 10 is limited by the lower face of the recessed head 4 abutting against the edges 6*b* of the tube 6.

The spring 10 is housed in the cage 11 between the two bases pierced with the central hole 12*c*, 13*c* in the space delimited by the side walls 12*a*, 13*a* and the flange 12*e*, 13*e* of the central holes. This arrangement allows in use to rotate the spring with the cage, which prevents its premature ageing caused by relative movement between the spring and a rotating component.

Figure 4:
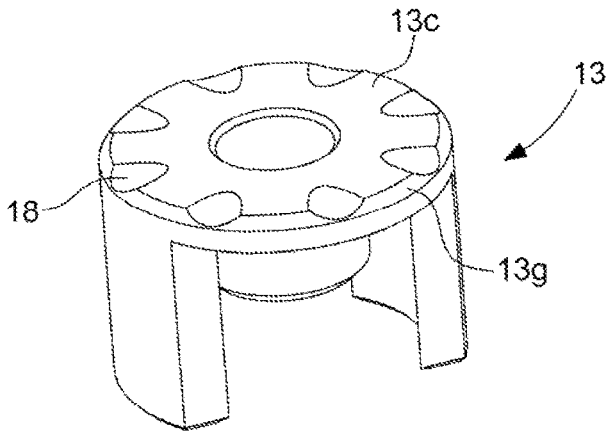
FIG. 4 shows a three-dimensional view of the lower portion of the spring cage according to the invention.
Figure 5:
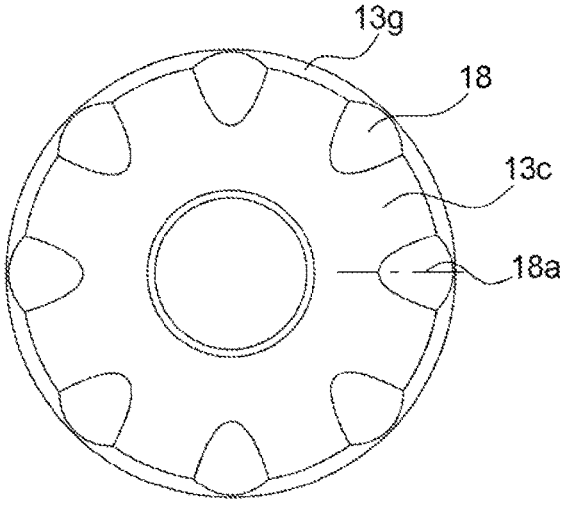
FIG. 5 is a plan view of the base of the spring cage according to the invention.
Figure 7:
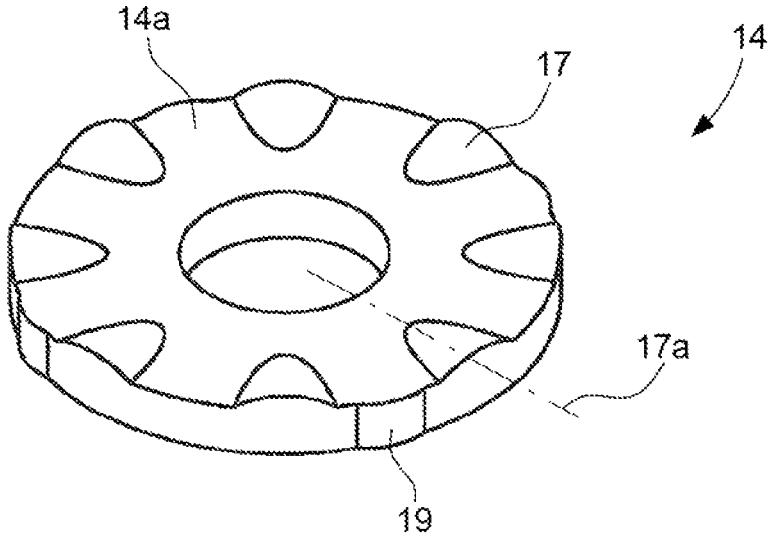
FIG. 7 is a three-dimensional view of the washer according to the invention.

According to the invention, the cage 11 includes on the base 13*c* of its lower portion 13, and more specifically on the face of the cage facing the seat 6*a*, cells 18 intended to cooperate with protuberances 17 formed in the washer 14 as shown in FIGS. 3, 4 and 7. The protuberances and the cells are present in the same number and are of complementary shape so as to fit into each other. Thanks to the protuberances passing from cell to cell, the rotation of the crown-push-button is accompanied by a click.

Advantageously, the cells and the protuberances are distributed with a regular angular interval on respectively the base 13*c* of the cage 13 and the upper face 14*a* of the washer 14. Preferably, the protuberances and the cells projecting in the plane of the base and of the washer have an oval shape with a circumference flaring towards the perimeter of the washer and the base. The cells and the protuberances have a circular arc-shaped transverse section, the circular arc having an increasing length in the direction of the perimeter of the washer and of the base of the cage. Transverse means the direction perpendicular to the radial direction and the direction parallel to the axis 7*a* of the rod 7.

Figure 6A:
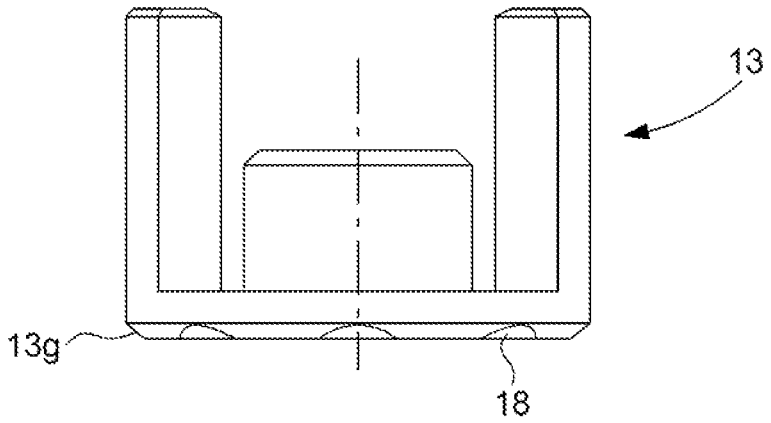
FIG. 6A is a side view of the lower portion of the spring cage according to the invention.
Figure 6B:
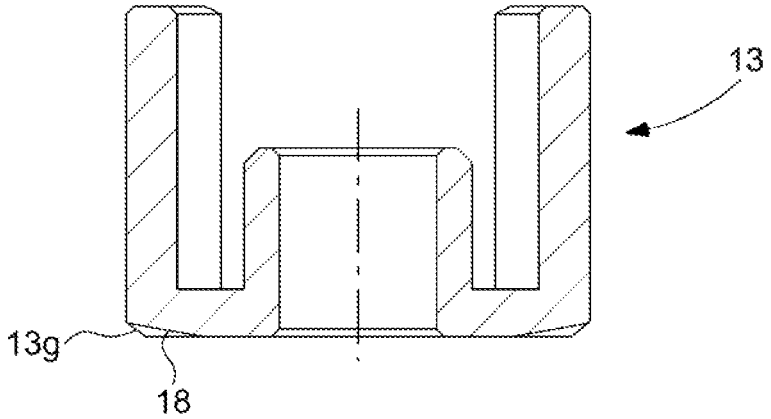
FIG. 6B is a sectional view of the lower portion of the spring cage according to the invention.
Figure 8:
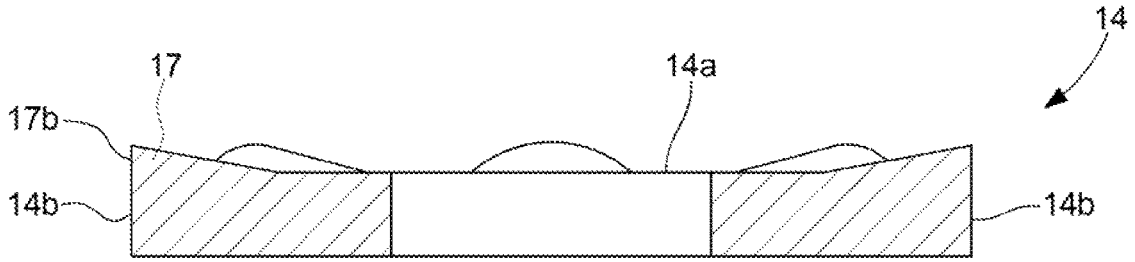
FIG. 8 is a sectional view of the washer according to the invention.

Preferably, the cells and the protuberances are distributed over the periphery of the base of the cage and of the upper face of the washer. More preferably, the protuberances and the cells open onto the perimeter respectively of the washer and the base of the cage. Preferably, the cells 18 are hollowed out in the thickness of the bevel 13*g* of the base 13C of the cage lower portion 13 (FIG. 4). Along its axis of symmetry 18*a* in the direction of the periphery of the base, the cell 18 has a depth increasing linearly from the plane of the base to a depth corresponding to the thickness of the bevel 13*g* at the periphery (FIG. 6B). By mirroring, the washer 14 includes curved protuberances 17 intended to be housed in the cells 18. Thus, the protuberances 17 have an increasing thickness along their axis of symmetry 17*a* until they emerge on the perimeter of the washer 14 with a circular arc-shaped vertical wall 17*b* aligned with the vertical wall 14*b* of the washer (FIGS. 3, 7 and 8).

Figure 9:
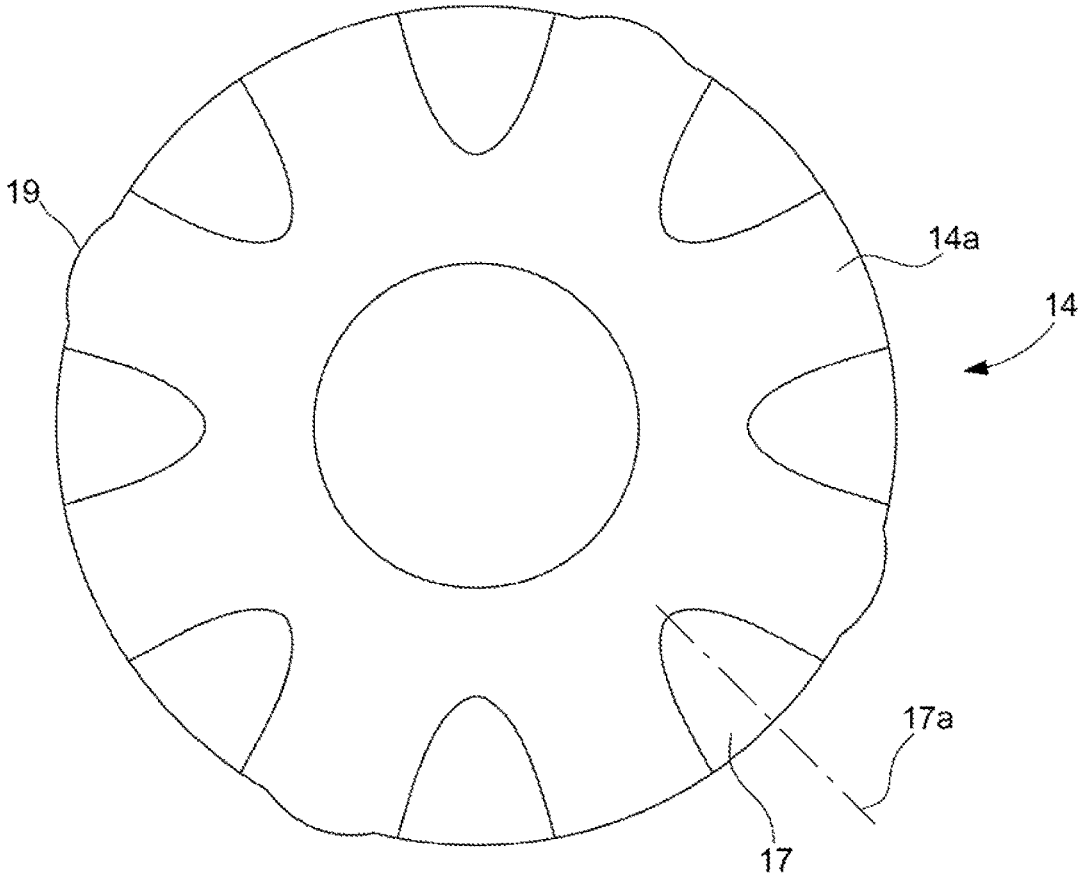
FIG. 9 is a plan view of the washer according to the invention.

Advantageously, the vertical wall 14*b* of the washer is also provided with lugs 19 extending radially, the lugs being intended to block the washer in rotation within the tube (FIGS. 7 and 9).

Finally, it will be specified that the protuberances could be provided on the base of the cage and the cells in the washer without departing from the scope of the invention. Furthermore, although more complex to produce, the present invention does not exclude that the protuberances are directly machined in the seat of the tube, the crown-push-button then having no washer.

LEGEND (1) Case
(2) Middle part
(3) Crown-push-button
(4) Recessed head
(5) Core
(6) Tube
  a. Seat
  b. Edge
(7) Rod
  a. Axis (8) Retaining element
(9) Multipolar magnet
(10) Return spring
(11) Cage
(12) Upper portion of the cage
a. Side wall
b. Opening
c. Base with a central hole
d. Open base
e. Central hole flange
f. Sidewall portion
(13) Lower portion of the cage
a. Side wall
b. Opening
c. Base with a central hole
d. Open base
e. Central hole flange
f. Sidewall portion
g. Bevel
(14) Washer
a. Upper face
b. Vertical wall
(15) Seal
(16) Cover
(17) Protuberance
a. Axis of symmetry
b. Vertical portion
(18) Cell
a. Axis of symmetry
(19) Lug

The invention claimed is:

1. A crown-push-button (3) comprising:

a tube (6) intended to be fixed to a watch case (1), a recessed head (4) integral with a rod (7) extending in its recessed portion, the rod (7) defining an axis (7*a*), said recessed head (4) being mounted movable in rotation and in translation respectively around and along the axis (7*a*) of the rod (7), a return spring (10) disposed around the rod (7), a cage (11) housing the spring (10), said cage (11) being traversed by the rod (7) and including an upper portion (12) integral with the recessed head (4) and a lower portion (13) mounted free relative to the recessed head (4), said upper portion (12) cooperating with the lower portion (13) so as to be able to drive the lower portion (13) in its rotational movement and so as to be able to move in translation along the axis (7*a*) relative to said lower portion (13), said spring (10) being mounted in compression within the cage (11) so as to be rotated with said cage (11), the cage (11) bearing at one axial end on an inner face of the recessed head (4) and at its other axial end on a washer (14) disposed on a seat (6*a*) of the tube (6), the bearing between the cage (11) and the washer (14) taking place between a base (13*c*) of the lower portion (13) of the cage (11) and an upper face (14*a*) of the washer (14), the crown-push-button (3) being wherein the upper face (14*a*) of the washer (14) and the base (13*c*) of the cage (11) respectively include protuberances (17) and cells (18) or conversely cells (18) and protuberances (17), the protuberances (17) cooperating with the cells (18) during the rotation of the crown-push-button (3) so as to create a click.

2. The crown-push-button (3) according to the preceding claim, wherein a number of protuberances (17) and cells (18) is identical and wherein the protuberances (17) and the cells (18) are of complementary shape so as to fit into each other.

3. The crown-push-button (3) according to claim 1, wherein the protuberances (17) and the cells (18) are distributed with a regular angular interval on respectively either the base (13*c*) of the lower portion (13) of the cage (11), or the upper face (14*a*) of the washer (14).

4. The crown-push-button (3) according to claim 1, wherein the protuberances (17) and the cells (18) are distributed over a periphery respectively either of the base (13*c*) or of the upper face (14*a*) of the washer (14).

5. The crown-push-button (3) according to claim 1, wherein the protuberances (17) and the cells (18) open onto a perimeter respectively either of the base (13*c*), or of the upper face (14*a*) of the washer (14).

6. The crown-push-button (3) according to claim 1, wherein the protuberances (17) and the cells (18) have a circular arc-shaped section in a direction parallel to the axis (7*a*).

7. The crown-push-button (3) according to claim 6, wherein the circular arc has an increasing length in the direction of a perimeter of the base (13*c*) and of the upper face (14*a*) of the washer (14).

8. The crown-push-button (3) according to claim 1, wherein the protuberances (17) and the cells (18) respectively have a height and a depth increasing in a radial direction towards the periphery of the base (13*c*) and the upper face (14*a*) of the washer (14).

9. The crown-push-button (3) according to claim 1, wherein the protuberances (17) and the cells (18) are respectively provided on the upper face (14*a*) of the washer (14) and the base (13*c*) of the lower portion (13) of the cage (11).

10. The crown-push-button (3) according to claim 9, wherein the perimeter of the base (13*c*) is bevelled (13*g*), the cells (18) having at the perimeter of the base (13*c*) and at their axis of symmetry (18*a*) a depth corresponding to the thickness of the bevel (13*g*).

11. The crown-push-button (3) according to claim 1, wherein the upper portion (12) and the lower portion (13) have the same cylindrical shape with a side wall (12*a*, 13*a*) provided with at least one opening (12*b*, 13*b*), the side wall (12*a*, 13*a*) being delimited at one end by the base pierced with a central hole (12*c*, 13*c*) for the passage of the rod (7) and at the other end by another fully open base (12*d*, 13*d*), the upper portion (12) and the lower portion (13) being mounted in the opposite direction relative to each other and coaxially around the rod (7) with a portion (12*f*) of the side wall (12*a*) of the upper portion (12) fitting into an opening (13*b*) of the side wall (13*a*) of the lower portion (13).

12. The crown-push-button (3) according to claim 11, wherein the opening (12*b*, 13*b*) defines the contours of a U.

13. The crown-push-button (3) according to claim 11, wherein there are two openings (12*b*, 13*b*) in the upper portion (12) and in the lower portion (13), the openings (12*b*, 13*b*) of each portion (12,13) being diametrically opposite relative to the axis (7*a*) of the rod (7).

14. The crown-push-button (3) according to claim 1, wherein the cage (11) is fixed in its upper portion (12) to a core (5) extending from the inner face of the recessed head (4) and disposed around the rod (7).

15. The crown-push-button (3) according to claim 11, wherein the spring (10) is housed in the cage (11) between said base and the other base respectively pierced with the central hole (12*c*, 13*c*) in the space delimited by the side walls (12*a*, 13*a*) and a flange (12*e*, 13*e*) of the central holes.

16. The crown-push-button (3) according to claim 11, wherein the portion (12*f*) of the side wall (12*a*) of the upper portion (12) is partially engaged in the opening (13*b*) of the lower portion (13) when the recessed head (4) is in its axially furthest position from the tube (6), the portion (12*f*) of the side wall (12*a*) of the upper portion (12) being engaged deeper into the opening (13*b*) of the lower portion (13) when the recessed head (4) is in its axially closest position to the tube (6).

17. An electronic or mechanical watch comprising a crown-push-button (3) comprising:

a tube (6) intended to be fixed to a watch case (1), a recessed head (4) integral with a rod (7) extending in its recessed portion, the rod (7) defining an axis (7*a*), said recessed head (4) being mounted movable in rotation and in translation respectively around and along the axis (7*a*) of the rod (7), a return spring (10) disposed around the rod (7), a cage (11) housing the spring (10), said cage (11) being traversed by the rod (7) and including an upper portion (12) integral with the recessed head (4) and a lower portion (13) mounted free relative to the recessed head (4), said upper portion (12) cooperating with the lower portion (13) so as to be able to drive the lower portion (13) in its rotational movement and so as to be able to move in translation along the axis (7*a*) relative to said lower portion (13), said spring (10) being mounted in compression within the cage (11) so as to be rotated with said cage (11), the cage (11) bearing at one axial end on an inner face of the recessed head (4) and at its other axial end on a washer (14) disposed on a seat (6*a*) of the tube (6), the bearing between the cage (11) and the washer (14) taking place between a base (13*c*) of the lower portion (13) of the cage (11) and an upper face (14*a*) of the washer (14), the crown-push-button (3) being wherein the upper face (14*a*) of the washer (14) and the base (13*c*) of the cage (11) respectively include protuberances (17) and cells (18) or conversely cells (18) and protuberances (17), the protuberances (17) cooperating with the cells (18) during the rotation of the crown-push-button (3) so as to create a click.

18. The electronic or mechanical watch according to claim 17, further comprising a magnetic crown-push-button.

* * * * *